United States Patent [19]

Hartvig

[11] 4,130,418

[45] Dec. 19, 1978

[54] AUSTENITIC WEAR-RESISTANT STEEL

[75] Inventor: Tor Hartvig, Raufoss, Norway

[73] Assignee: Raufoss Ammunisjonsfabrikker A/S, Raufoss, Norway

[21] Appl. No.: 839,127

[22] Filed: Oct. 3, 1977

[51] Int. Cl.[2] ..... C22C 38/04; C22C 38/14; C22C 38/28; C22C 38/38

[52] U.S. Cl. ..... 75/126 B; 75/123 N; 75/123 M; 75/126 D

[58] Field of Search ..... 75/123 N, 123 M, 126 B, 75/126 D; 148/38

[56] References Cited

U.S. PATENT DOCUMENTS

| | | | |
|---|---|---|---|
| 3,118,760 | 1/1964 | Avery et al. | 75/123 N |
| 3,839,022 | 10/1974 | Webster et al. | 75/126 B |

FOREIGN PATENT DOCUMENTS

| | | | |
|---|---|---|---|
| 276048 | 1927 | United Kingdom | 75/123 N |

*Primary Examiner*—Arthur J. Steiner
*Attorney, Agent, or Firm*—Holman & Stern

[57] ABSTRACT

Austenitic steel having 16–23% Mn, 1.1–1.5% C, 0–4% Cr, 0.1–0.5% Ti, the remainder being Fe and impurities.

4 Claims, No Drawings

AUSTENITIC WEAR-RESISTANT STEEL

The invention relates to a new type of austenitic wear-resistant steel. The object of the invention is to increase the resistance of the steel to abrasive and combined abrasive/impact-induced wear, as compared to the wear resistance of Mn 12 Hadfield steel, which has the following chemical composition:
1.0–1.35% C, 0–1.0% Si, 11.0–14% Mn
according to Norwegian Standard 16.

The invention is characterized in that the austenitic steel has the following chemical composition:
16–23% Mn,
1.1–1.5% C,
0–4% Cr,
0.1–0.5% Ti,
and the usual trace impurities from the smelting process, the remainder being Fe.

It has been maintained that the only effect of increasing the proportion of Mn to above 14% in austenitic wear-resistant steel is to increase its cost. I believe that I can refute that allegation with this invention. Steel having a Mn content of 16–23% exhibits increased resistance to wear by abrasion, provided that the other provisions described are followed.

Increasing the C content increases the hardness following heat treatment. A corresponding difference in hardness will still be present following work hardening. As a result, if one compares the resistance to purely abrasive wear of this alloy to cast-iron grades, the alloy has almost as good wear-resistance properties but not the brittleness of cast iron. If the C content is over 1.5%, it will be difficult to dissolve the carbides in the cast structure, so the resultant product would be sensitive to crack propagation.

The Cr content should be in the range of 0–4%, depending on the area of application for the alloy. Chromium also increases the hardness of steel following heat treatment, as well as increasing the ability of the steel to resist deformation upon impact. Chromium has a carbide-stabilizing effect, and the proportion of Cr must therefore be held below the given maximum value in order to avoid crack formation in thick cross sections. At low C content, the addition of Cr will encourage martensite formation. This means that if the C content of the steel is too low, an undesired and extremely brittle martensite will be formed in decarburized surfaces. This problem is overcome by the invention.

In order to make this alloy suitable also for thick-walled cross sections, the grain-size-reducing element Ti is added in an amount of from 0.1–0.5%. The amount of Ti is dependent on the area of application and the wall thickness. Titanium increases the ability of the alloy to withstand abrasive wear and to withstand powerful impact because it reduces the risk of crack formation. The addition of Ti eliminates or reduces the zone of columnar crystals and forms a fine-grained equiaxial structure which gives a relatively ductile cast structure.

In order to demonstrate the abrasive wear resistance of the new alloy in more detail, some experimental test results are given in the following tables.

Table I

Chemical composition (percent by weight) of various samples of new alloy; Mn 12 Hadfield steel used as reference (R).

| Alloy No. | % C | % Mn | % Si | % Ti | % P | % Cr |
|---|---|---|---|---|---|---|
| 51 | 1.42 | 18.0 | 0.70 | 0.14 | 0.044 | 2.37 |
| 55 | 1.42 | 19.5 | 0.75 | 0.14 | 0.025 | — |
| 58 | 1.50 | 21.7 | 0.63 | 0.13 | 0.025 | 3.15 |
| 59 | 1.38 | 18.4 | 0.57 | 0.013 | 0.023 | 2.55 |
| R | 1.18 | 12.3 | 0.82 | — | 0.042 | 0.40 |

Table II

Normalized wear-resistance ratings at various levels of wear (A×N×P) for purely abrasive wear. The normalized wear value is obtained by dividing the amount of wear on the test sample material by the amount of wear on the reference material at the same wear level.
A = number of times N between each wear measurement
N = number of revolutions between each repositioning of the abrasive paper
P = loading on the sample

| | SiC 150 abrasive | | | | $SiO_2$ 120 abrasive | | | |
|---|---|---|---|---|---|---|---|---|
| Alloy No. | A×N×P 600 | A×N×P 1800 | A×N×P 3600 | A×N×P 6000 | A×N×P 600 | A×N×P 1800 | A×N×P 3600 | A×N×P 6000 |
| 51 | 0.775 | 0.776 | 0.789 | 0.800 | 0.641 | 0.864 | 0.761 | 0.696 |
| 55 | 0.832 | 0.722 | 0.767 | 0.837 | 0.769 | 0.856 | 0.746 | 0.707 |
| 58 | | 0.867 | 0.884 | | 0.667 | 0.768 | 0.764 | 0.696 |
| 59 | | 0.944 | 1.039 | | 0.795 | 0.880 | 0.837 | 0.828 |
| R | 1 | 1 | 1 | 1 | 1 | 1 | 1 | 1 |

Table III

Vickers hardness ratings at various wear levels, test run using SiC 150 abrasive on samples 51, 55 and R. The table shows HV 3.

| Alloy No. | A×N×P 0 | A×N×P 600 | A×N×P 1800 | A×N×P 3600 | A×N×P 6000 | Average |
|---|---|---|---|---|---|---|
| 51 | 292 | 297 | 321 | 296 | 288 | 299 |
| 55 | 270 | 268 | 286 | 244 | 272 | 268 |
| R | 220 | 233 | 245 | 244 | 265 | 241 |

In order to evaluate the new alloy's resistance to wear resulting from impact and abrasion combined, tests were carried out in a pan machine, using rounded stones in stage 1 and a combination of round stones followed by crushed granite, grade 15–25, in stage 2.

Table IV

Normalized wear ratings and hardness values from the pan machine test, stage 1.

| Alloy No. | 7000 rev. | 24,000 rev. | 50,000 rev. | HV 3 unworn surface | HV 3 worn surface | Diff. |
|---|---|---|---|---|---|---|
| 51 | 0.861 | 0.840 | 0.835 | 329 | 591 | 262 |
| R | 1 | 1 | 1 | 267 | 535 | 268 |

Table V

| Normalized wear ratings and hardness values from the pan machine test, stage 2. | | | | | |
|---|---|---|---|---|---|
| | Round stone, 25–40 | | Crushed granite, 15–25 | | HV 30, worn surface |
| Alloy No. | 7000 rev. | 40,000 rev. | 57,000 rev. | 78,000 rev. | 78,000 rev. |
| 51 | 0.902 | 0.827 | 0.814 | 0.806 | 648 |
| 55 | 0.982 | 0.896 | 0.898 | 0.901 | 648 |
| 58 | 0.920 | 0.837 | 0.812 | 0.800 | 614 |
| 59 | 0.911 | 0.856 | 0.846 | 0.830 | 622 |
| R | 1 | 1 | 1 | 1 | 606 |

Tests on samples of the same alloys were then run in the pan machine where the abrasive mass was a mixture of crushed granite, grade 5–25, and 30-mm-diameter steel balls. The ratio of granite to steel balls was approximately 4:1. The great weight of the steel balls results in a greater surface pressure against the test bars.

Table VI

| Normalized wear ratings after 130,000 revolutions of the pan. | |
|---|---|
| Alloy No. | Normalized Wear Rating |
| 51 | 0.715 |
| 55 | 0.855 |
| 58 | 0.725 |
| 59 | 0.830 |
| R | 1 |

It can be seen from these results that the addition of Ti clearly improves the resistance to purely abrasive wear, while this improvement is somewhat less marked, but clear enough, with combined impact/abrasive stresses. The addition of Cr has a very positive effect against combined abrasive/impact stresses. For pure wear resistance, the addition of Cr is not necessary.

The above test results show that this new wear-resistant steel has 25–30% greater resistance to abrasion and combined abrasive/impact wear than Mn 12 Hadfield steel.

These results have also been verified by operational tests.

The steel can be produced by conventional methods, similar to Mn 12 Hadfield steel. Owing to the carbide stabilization effect of the Cr, quenching must occur at a higher temperature than for conventional Mn 12 Hadfield steel.

Having described my invention, I claim:

1. An austenitic wear-resistant steel having good wear resistance when subjected to abrasive and combined abrasive/impact stresses, the steel consisting essentially of, by weight:

16–23% Mn,
1.1–1.5% C,
0–4% Cr,
0.1–0.5% Ti, and the remainder being Fe.

2. The austenitic wear-resistant steel as claimed in claim 1, consisting of, by weight:

18.0% Mn,
1.42% C,
2.37% Cr,
0.14% Ti,
0.70% Si,
0.044% P and the remainder being Fe.

3. The austenitic wear-resistant steel as claimed in claim 1, consisting of, by weight:

19.5% Mn,
1.42% C,
0.14% Ti,
0.75% Si,
0.025% P and the remainder being Fe.

4. The austenitic wear-resistant steel as claimed in claim 1, consisting of, by weight:

21.7% Mn,
1.50% C,
3.15% Cr,
0.13% Ti,
0.63% Si,
0.025% P and the remainder being Fe.

* * * * *